US009718126B2

(12) United States Patent
Ownby et al.

(10) Patent No.: US 9,718,126 B2
(45) Date of Patent: Aug. 1, 2017

(54) MOLD ASSEMBLY CAPS USED IN FABRICATING INFILTRATED DOWNHOLE TOOLS

(71) Applicant: Halliburton Energy Services, Inc., Houston, TX (US)

(72) Inventors: Clayton A. Ownby, Houston, TX (US); Jeffrey G. Thomas, Magnolia, TX (US); Grant O. Cook, III, Spring, TX (US); Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/787,807

(22) PCT Filed: Dec. 2, 2014

(86) PCT No.: PCT/US2014/068070

§ 371 (c)(1),
(2) Date: Oct. 29, 2015

(87) PCT Pub. No.: WO2016/089370

PCT Pub. Date: Jun. 9, 2016

(65) Prior Publication Data

US 2016/0346833 A1 Dec. 1, 2016

(51) Int. Cl.
*B22C 9/02* (2006.01)
*B22D 27/04* (2006.01)
(Continued)

(52) U.S. Cl.
CPC ..... *B22D 27/045* (2013.01); *B22C 9/02* (2013.01); *B22C 9/10* (2013.01); *B22C 9/22* (2013.01);
(Continued)

(58) Field of Classification Search
CPC .. B22C 9/02; B22C 9/22; B22D 19/06; B22D 19/14; B22D 23/06; B22D 27/045
(Continued)

(56) References Cited

U.S. PATENT DOCUMENTS 5,839,329 A * 11/1998 Smith ..... B22F 3/1055 76/104.1
8,261,632 B2 * 9/2012 Stevens ..... B22F 7/062 76/108.4
(Continued)

FOREIGN PATENT DOCUMENTS

JP 06304736 11/1994
JP 11-028596 2/1999

OTHER PUBLICATIONS

International Search Report and Written Opinion for PCT/US2014/068070 dated Sep. 2, 2015.

*Primary Examiner* — Kevin E Yoon
(74) *Attorney, Agent, or Firm* — McDermott Will & Emery LLP

(57) ABSTRACT

An example mold assembly system includes a mold assembly including a mold forming a bottom of the mold assembly, a funnel operatively coupled to the mold, and an infiltration chamber defined at least partially by the mold and the funnel, the infiltration chamber being used for forming an infiltrated downhole tool. A mold assembly cap is positionable on the mold assembly and including a sidewall extendable about an outer periphery of the mold assembly at least partially along a height of the mold assembly. The sidewall exhibits a horizontal cross-sectional shape that accommodates a shape of the mold assembly and the sidewall is made of a thermal material that promotes directional solidification of the infiltrated downhole tool during fabrication.

27 Claims, 8 Drawing Sheets

(51) Int. Cl.

| | |
|---|---|
| ***B22C 9/10*** | (2006.01) |
| ***B22C 9/22*** | (2006.01) |
| ***B22D 19/06*** | (2006.01) |
| ***B22D 19/14*** | (2006.01) |
| ***B22D 23/06*** | (2006.01) |
| ***B22D 21/00*** | (2006.01) |
| ***B22D 21/06*** | (2006.01) |
| ***B22D 25/02*** | (2006.01) |

(52) U.S. Cl.
CPC ..... *B22D 19/06* (2013.01); *B22D 19/14* (2013.01); *B22D 21/005* (2013.01); *B22D 21/007* (2013.01); *B22D 21/06* (2013.01); *B22D 23/06* (2013.01); *B22D 25/02* (2013.01)

(58) Field of Classification Search
USPC ..... 164/97, 98, 122.1, 359
See application file for complete search history.

(56) References Cited

U.S. PATENT DOCUMENTS

| | | | | |
|---|---|---|---|---|
| 2010/0101747 | A1* | 4/2010 | Tomczak ..... | B22C 9/02<br>164/9 |
| 2010/0278604 | A1* | 11/2010 | Glass ..... | B22F 3/26<br>408/199 |
| 2011/0121475 | A1 | 5/2011 | Reese et al. | |
| 2013/0313403 | A1 | 11/2013 | Atkins et al. | |

* cited by examiner

MOLD ASSEMBLY CAPS USED IN FABRICATING INFILTRATED DOWNHOLE TOOLS

This application is a National Stage entry of and claims priority to International Application No. PCT/US2014/068070, filed on Dec. 2, 2014.

BACKGROUND

A variety of downhole tools are commonly used in the exploration and production of hydrocarbons. Examples of such downhole tools include cutting tools, such as drill bits, reamers, stabilizers, and coring bits; drilling tools, such as rotary steerable devices and mud motors; and other downhole tools, such as window mills, packers, tool joints, and other wear-prone tools. Rotary drill bits are often used to drill wellbores. One type of rotary drill bit is a fixed-cutter drill bit that has a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement materials within interior portions of the mold cavity. A preformed bit blank (or steel mandrel) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions.

This heat loss continues to a large extent until the mold is moved and placed on a cooling plate and an insulation enclosure or "hot hat" is lowered around the mold. The insulation enclosure drastically reduces the rate of heat loss from the top and sides of the mold while heat is drawn from the bottom of the mold through the cooling plate. This controlled cooling of the mold and the infiltrated matrix bit contained therein can facilitate axial solidification dominating radial solidification, which is loosely termed directional solidification.

As the molten material of the infiltrated matrix bit cools, there is a tendency for shrinkage that could result in voids forming within the bit body unless the molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing assuming they cannot be remedied. Every effort is made to detect these defects and reject any defective drill bit components during manufacturing to help ensure that the drill bits used in a job at a well site will not prematurely fail and to minimize any risk of possible damage to the well

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole tool manufacturing and, more particularly, mold assembly caps that help control the thermal profile of an infiltrated downhole tool during manufacture.

The embodiments disclosed herein describe various embodiments and configurations of a mold assembly cap that may be positioned over a mold assembly to modify the heat transfer into or out of the mold assembly, and thereby help promote directional solidification of an infiltrated downhole tool as it cools. The mold assembly caps described herein may be configured to fit directly over common mold assembly designs, such that changes to the design of mold assemblies are not required. The mold assembly caps may be positioned on the mold assembly at any stage of the infiltrated downhole tool fabrication process including, but not limited to, before placing the mold assembly in the furnace, during a pre-heat, while the mold assembly is in a furnace, while the mold assembly is in transition to a cooling location, and after the mold assembly is positioned within an insulation can. Among other things, this may improve quality and reduce the rejection rate of drill bit components due to defects during manufacturing.

Figure 1:
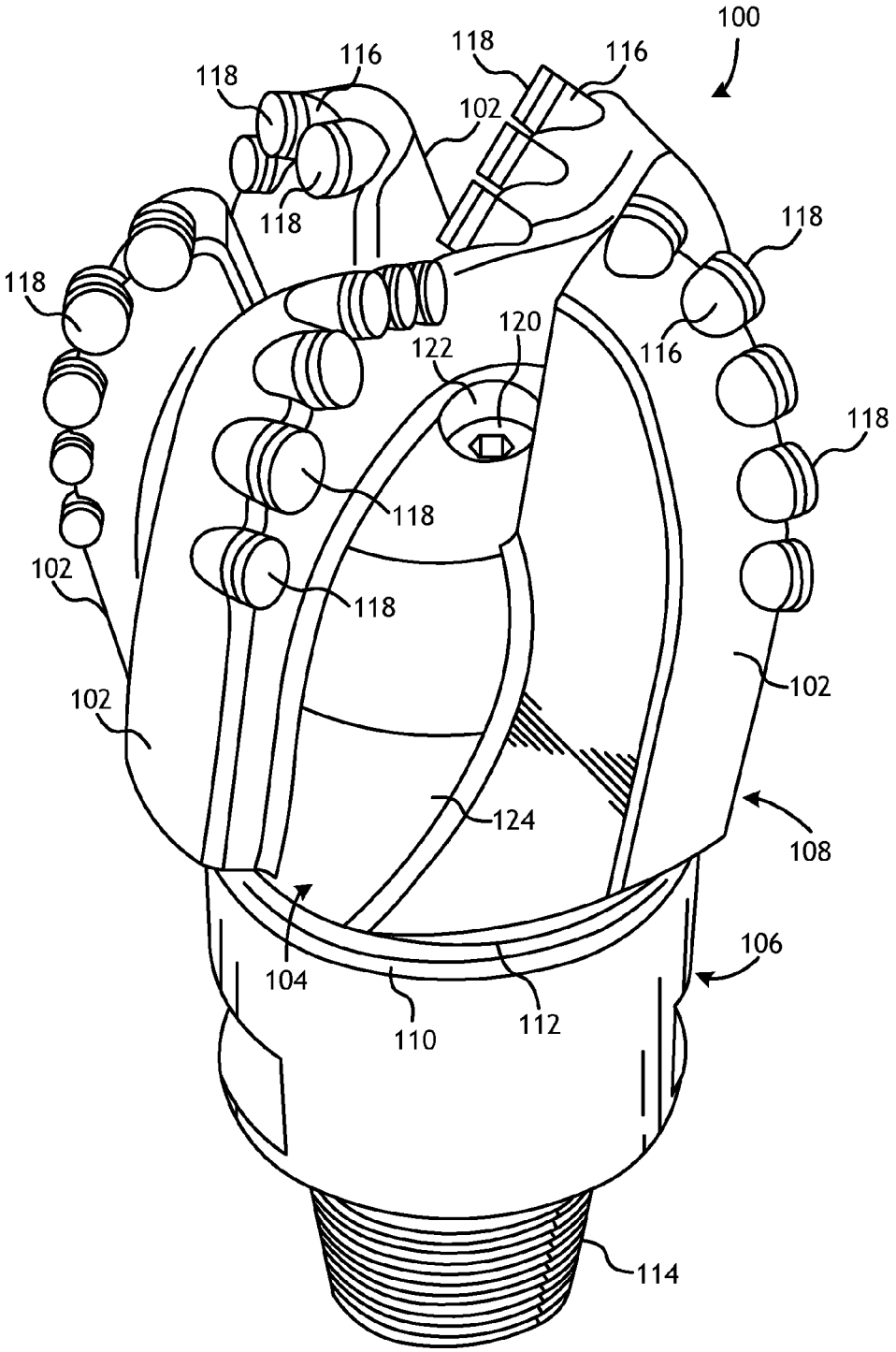
FIG. 1 is a perspective view of an exemplary fixed-cutter drill bit that may be fabricated in accordance with the principles of the present disclosure.

FIG. 1 illustrates a perspective view of an example fixed-cutter drill bit 100 that may be fabricated in accordance with the principles of the present disclosure. It should be noted that, while FIG. 1 depicts a fixed-cutter drill bit 100, the principles of the present disclosure are equally applicable to any type of downhole tool that may be formed or otherwise manufactured through an infiltration process. For example, suitable infiltrated downhole tools that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters, cutting elements), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, brazing, or other fusion methods, such as submerged arc or metal inert gas arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
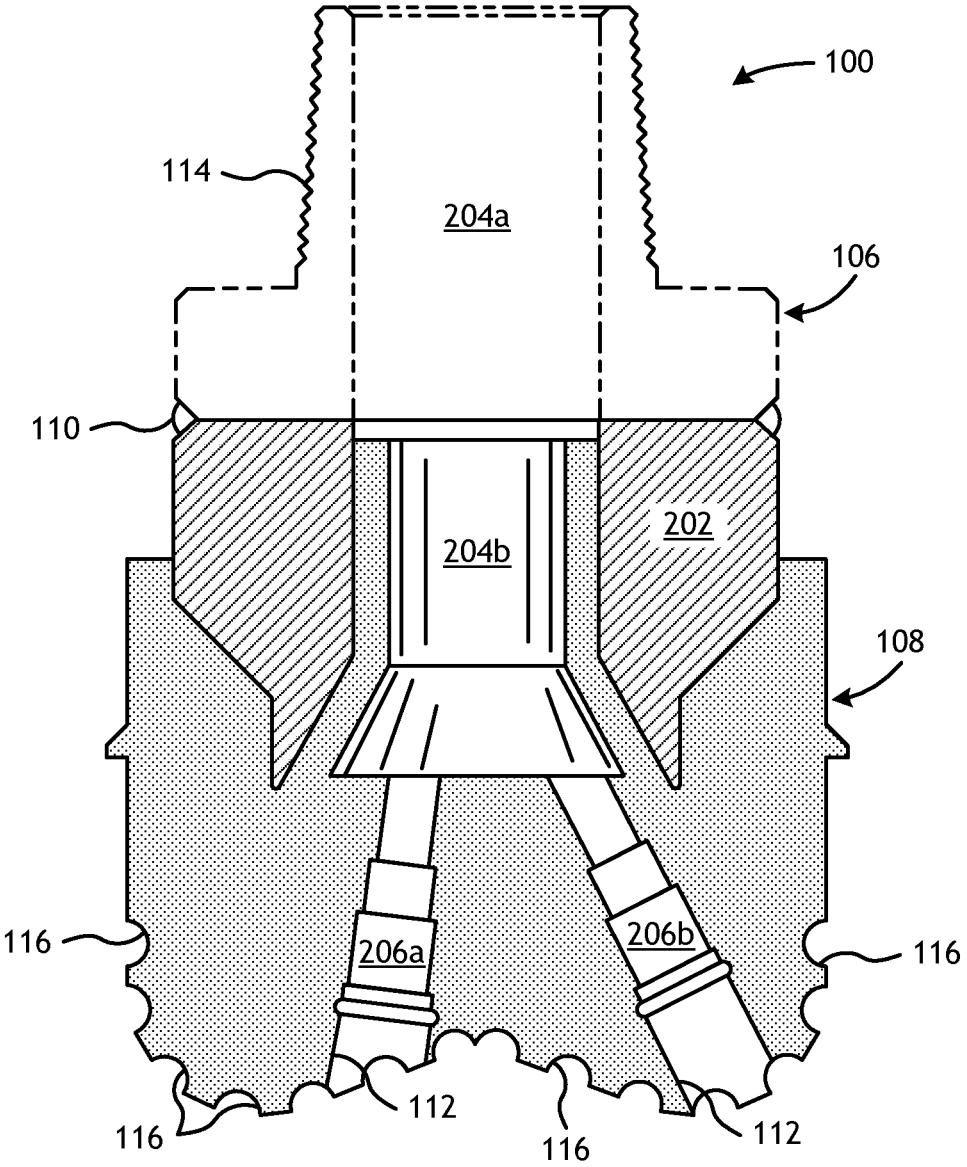
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108. At least one flow passageway (shown as two flow passageways 206*a* and 206*b*) may extend from the fluid cavity 204*b* to exterior portions of the bit body 108. The nozzle openings 122 may be defined at the ends of the flow passageways 206*a* and 206*b* at the exterior portions of the bit body 108. The pockets 116 are formed in the bit body 108 and are shaped or otherwise configured to receive the cutting elements 118 (FIG. 1).

Figure 3:
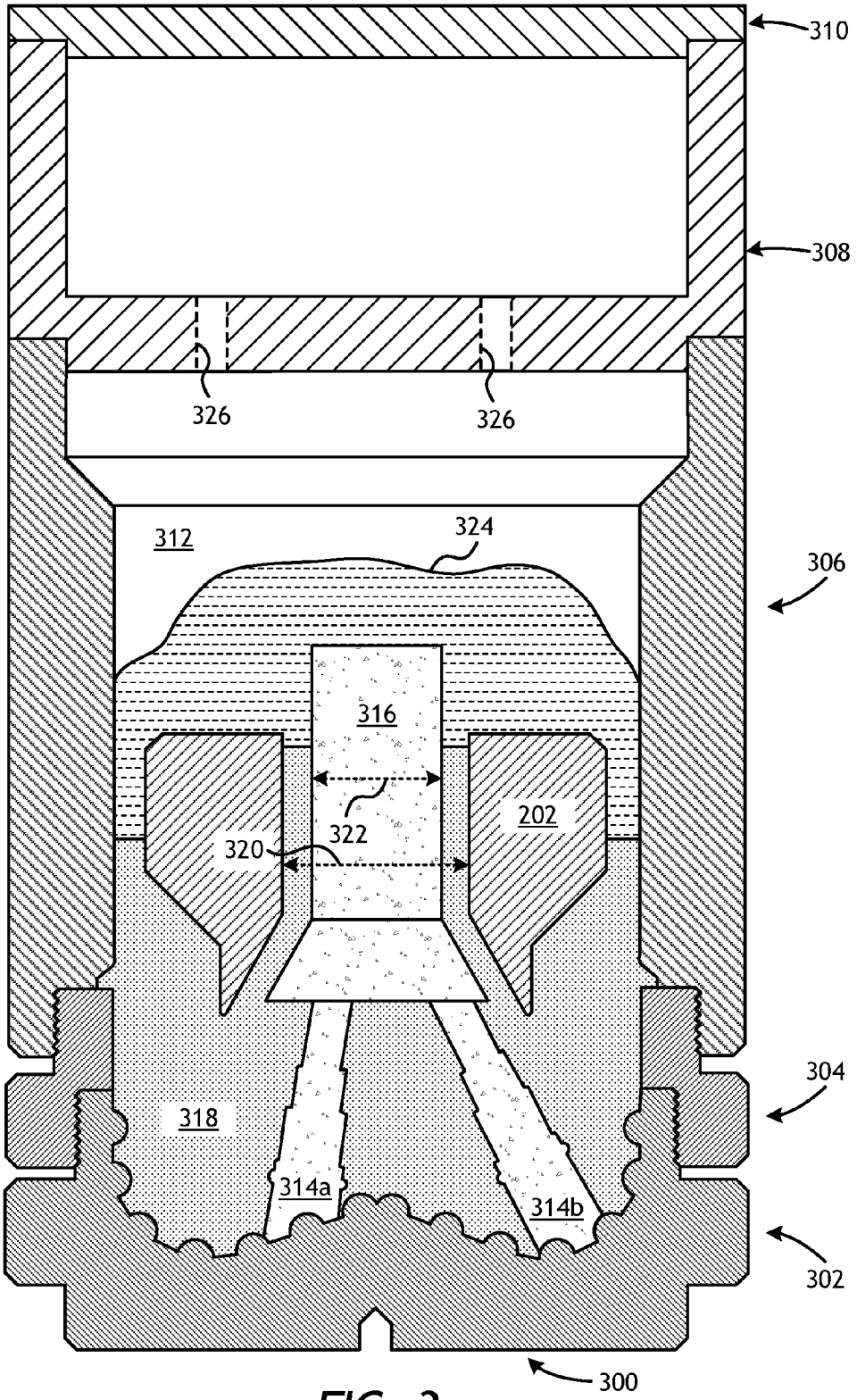
FIG. 3 is a cross-sectional side view of an exemplary mold assembly for use in forming the drill bit of FIG. 1.

FIG. 3 is a cross-sectional side view of a mold assembly 300 that may be used to form the drill bit 100 of FIGS. 1 and 2. While the mold assembly 300 is shown and discussed as being used to help fabricate the drill bit 100, those skilled in the art will readily appreciate that mold assembly 300 and its several variations described herein may be used to help fabricate any of the infiltrated downhole tools mentioned above, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may be instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Various techniques may be used to manufacture the mold assembly 300 and its components including, but not limited to, machining graphite blanks to produce the various components and thereby define the infiltration chamber 312 to exhibit a negative or reverse profile of desired exterior features of the drill bit 100 (FIGS. 1 and 2).

Materials, such as consolidated sand or graphite, may be positioned within the mold assembly 300 at desired locations to form various features of the drill bit 100 (FIGS. 1 and 2). For example, consolidated sand legs 314*a* and 314*b* may be positioned to correspond with desired locations and configurations of the flow passageways 206*a,b* (FIG. 2) and their respective nozzle openings 122 (FIGS. 1 and 2). Moreover, a cylindrically-shaped consolidated central displacement 316 may be placed on the legs 314*a,b*. The number of legs 314*a,b* extending from the central displacement 316 will depend upon the desired number of flow passageways and corresponding nozzle openings 122 in the drill bit 100.

After the desired materials, including the central displacement 316 and the legs 314*a,b*, have been installed within the mold assembly 300, matrix reinforcement materials 318 may then be placed within or otherwise introduced into the mold assembly 300. For some applications, two or more different types of matrix reinforcement materials 318 may be deposited in the mold assembly 300. Suitable matrix reinforcement materials 318 include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used.

The metal blank 202 may be supported at least partially by the matrix reinforcement materials 318 within the infiltration chamber 312. More particularly, after a sufficient volume of the matrix reinforcement materials 318 has been added to the mold assembly 300, the metal blank 202 may then be placed within mold assembly 300. The metal blank 202 may include an inside diameter 320 that is greater than an outside diameter 322 of the central displacement 316, and various fixtures (not expressly shown) may be used to position the metal blank 202 within the mold assembly 300 at a desired location. The matrix reinforcement materials 318 may then be filled to a desired level within the infiltration chamber 312.

Binder material 324 may then be placed on top of the matrix reinforcement materials 318, the metal blank 202, and the central displacement 316. Various types of binder materials 324 may be used and include, but are not limited to, metallic alloys of copper (Cu), nickel (Ni), manganese (Mn), lead (Pb), tin (Sn), cobalt (Co), Phosphorus (P), and silver (Ag). Various mixtures of such metallic alloys may also be used as the binder material 324. In some embodiments, the binder material 324 may be covered with a flux layer (not expressly shown). The amount of binder material 324 and optional flux material added to the infiltration chamber 312 should be at least enough to infiltrate the matrix reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300, thereby readying the mold assembly 300 for heating.

Figure 4A:
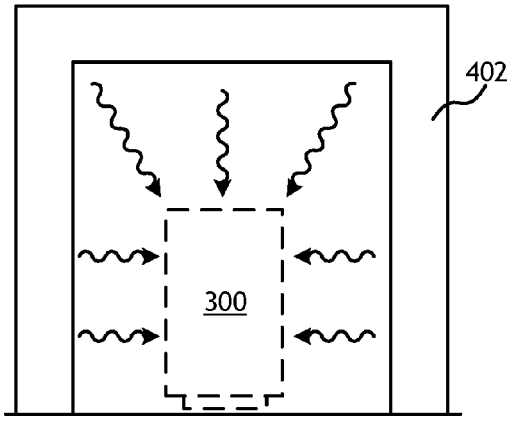
FIGS. 4A-4C are progressive schematic diagrams of an exemplary method of fabricating a drill bit.
Figure 4B:
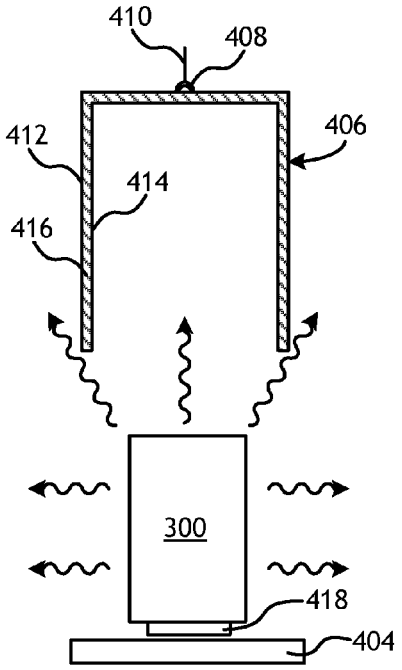
Figure 4C:
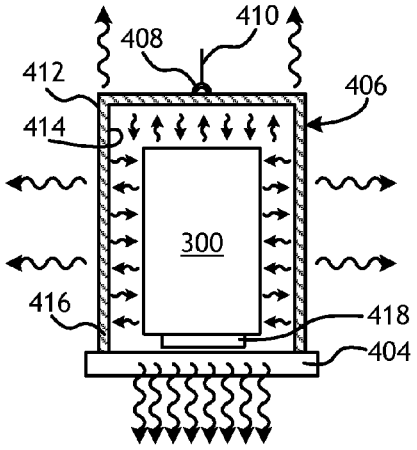

Referring now to FIGS. 4A-4C, with continued reference to FIG. 3, illustrated are schematic diagrams that sequentially illustrate an example method of heating and cooling the mold assembly 300 of FIG. 3, in accordance with the principles of the present disclosure. In FIG. 4A, the mold assembly 300 is depicted as being positioned within a furnace 402. The temperature of the mold assembly 300 and its contents are elevated within the furnace 402 until the binder material 324 liquefies and is able to infiltrate the matrix reinforcement materials 318. Once a specific location in the mold assembly 300 reaches a certain temperature in the furnace 402, or the mold assembly 300 is otherwise maintained at a particular temperature for a predetermined amount of time, the mold assembly 300 is then removed from the furnace 402 and immediately begins to lose heat by radiating thermal energy to its surroundings while heat is also convected away by cooler air outside the furnace 402. In some cases, as depicted in FIG. 4B, the mold assembly 300 may be transported to and set down upon a thermal heat sink 404.

The radiative and convective heat losses from the mold assembly 300 to the environment continue until an insulation enclosure 406 is lowered around the mold assembly 300. The insulation enclosure 406 may be a rigid shell or structure used to insulate the mold assembly 300 and thereby slow the cooling process. In some cases, the insulation enclosure 406 may include a hook 408 attached to a top surface thereof. The hook 408 may provide an attachment location, such as for a lifting member, whereby the insulation enclosure 406 may be grasped and/or otherwise attached to for transport. For instance, a chain or wire 410 may be coupled to the hook 408 to lift and move the insulation enclosure 406, as illustrated. In other cases, a mandrel or other type of manipulator (not shown) may grasp onto the hook 408 to move the insulation enclosure 406 to a desired location.

The insulation enclosure 406 may include an outer frame 412, an inner frame 414, and insulation material 416 arranged between the outer and inner frames 412, 414. In some embodiments, both the outer frame 412 and the inner frame 414 may be made of rolled steel and shaped (i.e., bent, welded, etc.) into the general shape, design, and/or configuration of the insulation enclosure 406. In other embodiments, the inner frame 414 may be a metal wire mesh that holds the insulation material 416 between the outer frame 412 and the inner frame 414. The insulation material 416 may be selected from a variety of insulative materials, such as those discussed below. In at least one embodiment, the insulation material 416 may be a ceramic fiber blanket, such as INSWOOL® or the like.

As depicted in FIG. 4C, the insulation enclosure 406 may enclose the mold assembly 300 such that thermal energy radiating from the mold assembly 300 is dramatically reduced from the top and sides of the mold assembly 300 and is instead directed substantially downward and otherwise toward/into the thermal heat sink 404 or back towards the mold assembly 300. In the illustrated embodiment, the thermal heat sink 404 is a cooling plate designed to circulate a fluid (e.g., water) at a reduced temperature relative to the mold assembly 300 (i.e., at or near ambient) to draw thermal energy from the mold assembly 300 and into the circulating fluid, and thereby reduce the temperature of the mold assembly 300. In other embodiments, however, the thermal heat sink 404 may be any type of cooling device or heat exchanger configured to encourage heat transfer from the bottom 418 of the mold assembly 300 to the thermal heat sink 404. In yet other embodiments, the thermal heat sink 404 may be any stable or rigid surface that may support the mold assembly 300, and preferably having a high thermal capacity, such as a concrete slab or flooring.

Once the insulation enclosure 406 is positioned over the mold assembly 300 and the thermal heat sink 404 is operational, the majority of the thermal energy is transferred away from the mold assembly 300 through the bottom 418 of the mold assembly 300 and into the thermal heat sink 404. This controlled cooling of the mold assembly 300 and its contents allows an operator (or an automated control system) to regulate or control the thermal profile of the mold assembly 300 to a certain extent and may result in directional solidification of the molten contents within the mold assembly 300, where axial solidification of the molten contents dominates radial solidification. Within the mold assembly 300, the face of the drill bit (i.e., the end of the drill bit that includes the cutters) may be positioned at the bottom 418 of the mold assembly 300 and otherwise adjacent the thermal heat sink 404 while the shank 106 (FIG. 1) may be positioned adjacent the top of the mold assembly 300. As a result, the drill bit 100 (FIGS. 1 and 2) may be cooled axially upward, from the cutters 118 (FIG. 1) toward the shank 106 (FIG. 1).

Such directional solidification (from the bottom up) may prove advantageous in reducing the occurrence of voids due to shrinkage porosity, cracks at the interface between the bit blank and the molten materials, and nozzle cracks. However, the insulating capability of the insulation enclosure 406 may require augmentation to produce a sufficient amount of directional cooling. According to embodiments of the present disclosure, as an alternative or in addition to using the insulation enclosure 406, the mold assemblies described herein may be modified to help influence the overall thermal profile of the infiltrated downhole tool being fabricated and thereby enhance directional cooling. More particularly, embodiments of the presently described mold assemblies include a mold assembly cap that may be positioned on the mold assembly and used to passively and/or actively improve directional solidification of an infiltrated downhole tool.

Referring now to FIGS. 5A-5F, illustrated are partial cross-sectional side views of the mold assembly 300 incorporating various designs and/or configurations of an exemplary mold assembly cap 500, according to one or more embodiments. The various embodiments of the mold assembly cap 500 in FIGS. 5A-5F as labeled as mold assembly caps 500*a-f*, respectively. Each mold assembly cap 500*a-f* (hereafter "caps 500*a-f*") may include a sidewall 502 configured to encompass and otherwise extend about the outer periphery of the mold assembly 300. In some embodiments, one or more of the caps 500*a-f* may further include a top member 504 that generally extends across the top of the mold assembly 300. In other embodiments, the top member 504 may be omitted from one or more of the caps 500*a-f*, without departing from the scope of the disclosure. In some embodiments, the top member 504 may be coupled to or otherwise form an integral part of the sidewall 502. In such embodiments, the sidewall 502 and the top member 504 may be formed as a single structure and otherwise coupled to form a monolithic structure. In other embodiments, however, the top member 504 may be independent of the sidewall 502 and otherwise form a separate component part of one or more of the caps 500*a-f*, without departing from the scope of the disclosure.

The caps 500*a-f* may be made of a thermal material that aids in the fabrication of the infiltrated downhole tool within the mold assembly 300. In some embodiments, for instance, one or more of the caps 500*a-f* may be used to insulate the mold assembly 300 during the cooling process and thereby promote directional solidification of the infiltrated downhole tool as it cools. In such embodiments, suitable thermal materials that may be used in the caps 500*a-f* include, but are not limited to, ceramics [e.g., oxides, carbides, borides, nitrides (e.g., silicon nitride), and silicides that may be crystalline, non-crystalline, or semi-crystalline], alumina ($Al_2O_3$), insulating metal composites, carbons, nanocomposites, foams, fluids (e.g., air, carbon dioxide, argon, nitrogen, etc.), any composite thereof, or any combination thereof. Such thermal materials may be in the form of beads, particulates, flakes, fibers, wools, woven fabrics, bulked fabrics, sheets, bricks, stones, blocks, cast shapes, molded shapes, foams, sprayed insulation, any hybrid thereof, or any combination thereof. Accordingly, examples of suitable thermal materials may include, but are not limited to, alumina, ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, and the like, any composite thereof, or any combination thereof.

In other embodiments, one or more of the caps 500*a-f* may be used as a thermal reservoir to passively modify heat transfer into or out of the mold assembly 300 during fabrication of the infiltrated downhole tool. In such embodiments, the caps 500*a-f* may be positioned on the mold assembly 300 when the mold assembly 300 is introduced into the furnace 402 (FIG. 4A) and the thermal material of the caps 500*a-f* may be heated within the furnace 402. In other embodiments, however, the one or more of the caps 500*a-f* may be pre-heated or heated without the furnace and positioned on the mold assembly 300 at any point during the fabrication process. Such thermal reservoir caps 500*a-f* may prove advantageous in imparting thermal energy to the infiltrated downhole tool to alter its thermal profile and thereby promoting controlled or directional solidification in the infiltrated downhole tool as it cools.

To suitably serve as a thermal reservoir, the thermal material may be a high heat capacity material such as, but not limited to, a monolithic block of ceramic (e.g., alumina), a ceramic-metal composite, a metal (e.g., steel), fireclay, fire brick, stone, graphite, and any combination thereof. Alternatively, the high heat capacity thermal material may comprise a multi-component mass or otherwise consist of several pieces or fragments of a thermal material and, in some embodiments, may be contained or otherwise retained within a suitable support structure or container, as described in more detail below. In such embodiments, the high heat capacity thermal material may include ceramic blocks, ceramic bricks, ceramic fibers, ceramic fabrics, ceramic wools, ceramic beads, a moldable ceramic, woven ceramics, cast ceramics, carbon fibers, graphite blocks, shaped or machined graphite blocks, metal fabrics, metal foams, metal wools, metal castings, metal blocks, fluid in a jacket, a phase change material, any composite thereof, and any combination thereof.

The sidewall 502 of each cap 500*a-f* may exhibit any suitable horizontal cross-sectional shape that accommodates the general shape of the mold assembly 300 including, but not limited to, circular, ovular, polygonal (e.g., square, rectangular, etc.), polygonal with rounded corners, or any hybrid thereof. In some embodiments, the sidewall 502 of one or more of the caps 500*a-f* may exhibit different sizes and/or thicknesses along an axial height A (FIG. 5A) and otherwise at different vertical or longitudinal locations. Each cap 500*a-f* may be configured to be positioned on the mold assembly 300 such that the sidewall 502 extends from the top of the mold assembly 300 and at least partially along a height B (FIG. 5A) of the mold assembly 300 toward the bottom thereof. In some embodiments, the sidewall 502 may extend along the entire height B of the mold assembly 300. In other embodiments, however, the sidewall 502 may extend along only a portion of the height B of the mold assembly 300, as illustrated.

Figure 5A:
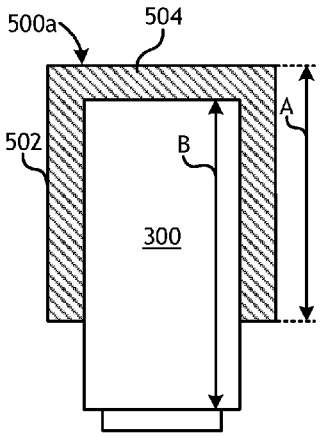
FIGS. 5A-5F are partial cross-sectional side views of the mold assembly of FIG. 3 incorporating various designs and/or configurations of an exemplary mold assembly cap.
Figure 5B:
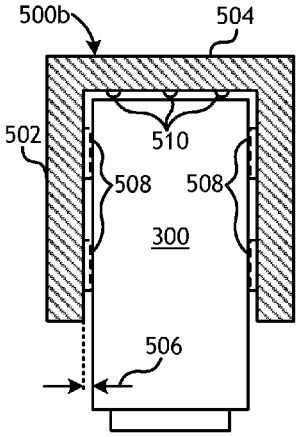

The caps 500*a-f* may be configured to be positioned on the mold assembly 300 such that they rest directly on adjacent outer surfaces of the mold assembly 300. In FIG. 5A, for instance, the cap 500*a* is depicted as having the inner surfaces of both the sidewall 502 and the top member 504 in direct physical contact with the adjacent outer surfaces of the mold assembly 300. In other embodiments, however, such as is depicted in FIG. 5B, a gap 506 may be defined between the cap 500*b* and the mold assembly 300. As illustrated in FIG. 5B, the cap 500*b* may include and otherwise define a plurality of longitudinal protrusions 508 disposed about the inner surface of the sidewall 502. The longitudinal protrusions 508 may be angularly spaced from each other along the inner surface of the sidewall 502 at, for example, 90° intervals, but could equally be spaced at other angular intervals, without departing from the scope of the disclosure. Moreover, in embodiments where the top member 504 is used, the cap 500*b* may further include one or more top protrusions 510 (three shown) defined on and otherwise extending from the inner surface of the top member 504.

The longitudinal and top protrusions 508, 510 may be configured to maintain the cap 500*b* radially and axially offset from the mold assembly 300 and thereby form or provide the gap 506. As will be appreciated, the gap 506 may prove advantageous in effectively creating a radiant barrier around the mold assembly 300 to redirect thermal energy radiated from the mold assembly 300 back towards the mold assembly 300, and thereby help slow the cooling process. In some embodiments, the cap 500*b* may include only the longitudinal protrusions 508 and omit the top protrusions 510. In other embodiments, however, the reverse may be employed where the cap 500*b* includes only the top protrusions 510 and instead omits the longitudinal protrusions 508.

Figure 5C:
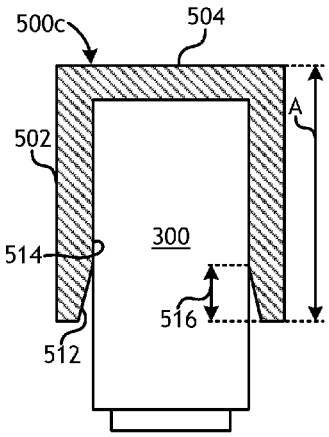
Figure 5D:
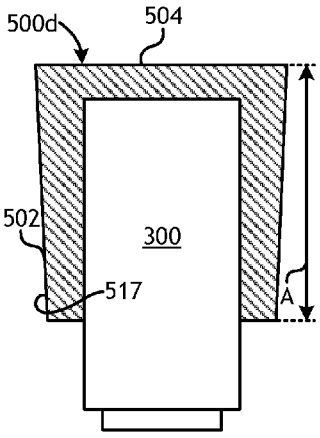

In FIGS. 5C and 5D, the caps 500*c* and 500*d*, respectively, are depicted as providing tapered surfaces. More particularly, the cap 500*c* of FIG. 5C provides or otherwise defines a tapered surface 512 on an inner wall 514 of the sidewall 502. As illustrated, the tapered surface 512 is an inward taper that extends toward the outer periphery of the mold assembly 300. The tapered surface 512 may exhibit a linear height 516 that extends along all or a portion of the height A of the cap 500*c*. In some embodiments, for instance, the linear height 516 of the tapered surface 512 may extend from the bottom to the top of the sidewall 502 or any distance therebetween, without departing from the scope of the disclosure. As will be appreciated, the tapered surface 512 of the inner wall 514 may prove advantageous in allowing the cap 500*c* to more easily be positioned on the mold assembly 300, as described in more detail below with reference to FIGS. 7A and 7B.

In FIG. 5D, the cap 500*d* exhibits an outward taper or, in other words, the thickness of the sidewall 502 varies along an axial height A of the cap 500*d*. More particularly, an outer wall 517 of the sidewall 502 may taper outward from the bottom to the top along the axial height A of the cap 500*d*. While depicted as linearly tapering outward, the outer wall 517 may alternatively taper non-linearly, without departing from the scope of the disclosure. Having the sidewall 502 taper outward may provide the cap 500*d* with increased thermal mass or thermal material at the top of the mold assembly 300, which may allow the cap 500*d* to maintain more heat at the top and thereby help promote directional solidification of the infiltrated downhole tool.

Figure 5E:
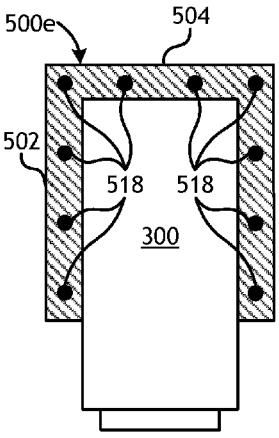

In some embodiments, one or more of the caps 500*a-f* may incorporate thermal elements that allow the given cap 500*a-b* to selectively and/or actively heat the mold assembly 300. In FIG. 5E, for example, the cap 500*e* is depicted as including one or more thermal elements 518 positioned within the sidewall 502 and the top member 504. As used herein, the term "positioned within" can refer to physically embedding the thermal elements 518 within one or both of the sidewall 502 and the top member 504 of any of the mold assembly caps described herein, but may also refer to embodiments where the thermal elements 518 form an integral part of any of the presently described mold assembly caps. In yet other embodiments, the thermal elements 518 may be positioned within any of the mold assembly caps described herein by being arranged within a cavity (not shown) defined within one or both of the sidewall 502 and the top member 504. Furthermore, the thermal elements 518 may be connected to or otherwise positioned on the sidewall 502 and/or top member 504 along the exterior surface to facilitate fabrication of the multi-material component. Alternatively, the thermal elements 518 may be connected to the interior surface of the sidewall 502 and/or top member 504 in conjunction with the longitudinal protrusions 508 (FIG. 5B) and/or top protrusions 510 (FIG. 5B) to provide heat directly to the outer surfaces of mold assembly 300.

The thermal elements 518 may in thermal communication with the contents of the mold assembly 300 (i.e., the infiltrated downhole tool), in that activation of the thermal elements 518 may result in thermal energy being imparted and/or transferred to the infiltrated downhole tool from the thermal elements 518. In some embodiments, the thermal elements 518 may actively and/or selectively provide thermal energy to undertake or help undertake the infiltration process of the infiltrated downhole tool. In such embodiments, the furnace 402 (FIG. 4A) may be omitted from the fabrication process and the infiltration step may instead be accomplished using the thermal elements 518. In other embodiments, however, the thermal elements 518 may help directional solidification of the infiltrated downhole tool as it cools following infiltration.

The thermal elements 518 may be any device or mechanism configured to impart thermal energy to the infiltrated downhole tool. For example, the thermal elements 518 may include, but are not limited to, a heating element, a heat exchanger, a radiant heater, an electric heater, an infrared heater, an induction heater, one or more induction coils, a heating band, one or more heated coils, a heated cartridge, a heated fluid (flowing or static), an exothermic chemical reaction, a microwave emitter, or any combination thereof. Suitable configurations for a heating element may include, but are not be limited to, coils, plates, strips, finned strips, and the like, or any combination thereof. In embodiments where the thermal elements 518 comprise a heated fluid or an exothermic chemical reaction, the heated fluid or the exothermic chemical reaction may be circulated or disposed within associated conduits arranged within the given component parts of the cap 500*a-f* or within the given component parts of the mold assembly 300.

In some embodiments, the thermal elements 518 may comprise fluid conduits configured to circulate a fluid that exhibits a suitable thermal conductivity to enable exchange thermal energy exchange between the infiltrated downhole tool and the thermal elements 518. Suitable fluids that may be circulated through conduits comprising the thermal elements 518 include, but are not limited to, a gas (e.g., air, carbon dioxide, argon, helium, oxygen, nitrogen), water, steam, an oil, a coolant (e.g., glycols), a molten metal, a molten metal alloy, a fluidized bed, or a molten salt. Suitable molten salts include alkali fluoride salts (e.g., LiF—KF, LiF—NaF—KF, LiF—RbF, LiF—NaF—RbF), $BeF_2$ salts (e.g., LiF—$BeF_2$, NaF—$BeF_2$, LiF—NaF—$BeF_2$), $ZrF_4$ salts (e.g., KF—$ZrF_4$, NaF—$ZrF_4$, NaF—KF—$ZrF_4$, LiF—$ZrF_4$, LiF—NaF—$ZrF_4$, RbF—$ZrF_4$), chloride-based salts (e.g., LiCl—KCl, LiCl—RbCl, KCl—$MgCl_2$, NaCl—$MgCl_2$, LiCl—KCl—$MgCl_2$, KCl—NaCl—$MgCl_2$), fluoroborate-based salts (e.g., NaF—$NaBF_4$, KF-$KBE_4$, RbF—$RbBF_4$), or nitrate-based salts (e.g., $NaNO_3$—$KNO_3$, $Ca(NO_3)_2$—$NaNO_3$—$KNO_3$, $LiNO_3$—$NaNO_3$—$KNO_3$), and any alloys thereof. Suitable molten metals or metal alloys may include Pb, Bi, Pb—Bi, K, Na, Na—K, Ga, In, Sn, Li, Zn, or any alloys thereof. Suitable molten metals or metal alloys for the fluid may further include a metal similar to the binder material 324 of FIG. 3 such as, but not limited to, copper, nickel, manganese, cobalt, silver, phosphorous, zinc, any alloys thereof, and any mixtures of the metallic alloys. Using a molten metal for the fluid that is similar to the binder material 324 may prove advantageous since they will each have the same solidus and liquidus temperatures. As a result, the molten metal may be able to provide latent heat to the molten contents of the mold assembly 300 at essentially the same thermal points.

In some embodiments, the thermal elements 518 positioned in the cap 500*e* may comprise a single thermal element 518 array and thereby form a spiraling or coiled single thermal element 518 when viewed from a top view. In such embodiments, the thermal element 518 may be controlled via a single lead (not shown) connected to the thermal element 518. In other embodiments, however, the thermal elements 518 in the cap 500*e* may comprise a collection of thermal elements 518 that may be controlled together, or two or more sets of thermal elements 518 that may be controlled independent of each other. In yet other embodiments, the thermal elements 518 in the cap 500*e* may comprise individual and discrete thermal elements 518 that are each powered independent of the others. In such embodiments, each thermal element 518 would require connection to a corresponding discrete lead to control and power the corresponding thermal elements 518. As will be appreciated, such embodiments may prove advantageous in allowing an operator to vary an intensity or heat output of each thermal element 518 independently, and thereby produce a desired heat gradient within the mold assembly 300.

In addition to the thermal materials described above that make up the sidewall 502 and the top member 504, in some embodiments, one or more surfaces of the caps 500*a-f* may be coated with a coating. In the cap 500*f* of FIG. 5F, for example, an inner surface 520*a* and/or an outer surface 520*b* of the cap 500*f* may be coated with a coating 522. In some embodiments, the coating 522 may be a reflective coating applied to one or both of the inner and outer surfaces 520*a,b*. The reflective coating may be adhered to and/or sprayed onto the inner and/or outer surfaces 520*a,b* to reflect an amount of thermal energy being transferred from the molten contents within the mold assembly 300 (FIG. 3) back toward the molten contents. Suitable materials for the reflective coating include a metal coating selected from group consisting of iron, chromium, copper, carbon steel, maraging steel, stainless steel, microalloyed steel, low alloy steel, molybdenum, nickel, platinum, silver, gold, tantalum, tungsten, titanium, aluminum, cobalt, rhenium, osmium, palladium, iridium, rhodium, ruthenium, manganese, niobium, vanadium, zirconium, hafnium, any derivative thereof, or any alloy based on these metals. A metal reflective coating may be applied via a suitable method, such as plating, spray deposition, chemical vapor deposition, plasma vapor deposition, a sleeve that is attached to the cap (e.g., via welds, bolts, rivets), etc. Another suitable material for the reflective coating may be a paint (e.g., white for high reflectivity, black for high absorptivity) or ceramic coating. In other embodiments, or in addition thereto, the inner surface 520*a* may be polished so as to increase its emissivity.

In other embodiments, the coating 522 may be a thermal barrier applied to one or both of the inner and outer surfaces 520*a,b*. The thermal barrier may provide resistance to radiation heat transfer between the mold assembly 300 and the thermal materials of the cap 500*f*. Suitable materials that may be used as the thermal barrier include, but are not limited to, aluminum oxide, aluminum nitride, silicon carbide, silicon nitride, quartz, titanium carbide, titanium nitride, yttria-stabilized zirconia, borides, carbides, nitrides, and oxides. The thermal barrier may be applied to the inner and/or outer surfaces 520*a,b* via a variety of processes or techniques including, but not limited to, electron beam physical vapor deposition, air plasma spray, high velocity oxygen fuel, electrostatic spray assisted vapor deposition, chemical vapor deposition, and direct vapor deposition. The thermal barrier may advantageously lower the radiosity (e.g., radiant heat flux) and/or lower the heat transfer through the cap 500*f*, thereby helping maintain heat within the mold assembly 300 and otherwise redirecting thermal energy back at the molten contents within the mold assembly 300.

In any of the caps 500*a-f*, the thermal material used or the configuration may be tailored such that the caps 500*a-f* are designed to retain heat in specific regions or sections of the mold assembly 300 along its height B (FIG. 5A). In some embodiments, for instance, one or more of the caps 500*a-f* may exhibit minimal cross-sectional volume or insulating capacity in certain areas about the periphery of the mold assembly 300 except for in desired areas. This may be accomplished by incorporating different types of thermal materials at different axial locations along the height A (FIGS. 5A, 5C, and 5D) of the caps 500*a-f*, or a thickness of the thermal material of the caps 500*a-f* may be altered at specific axial locations along the height A of the caps 500*a-f* to vary the thermal capabilities and properties.

Figure 5F:
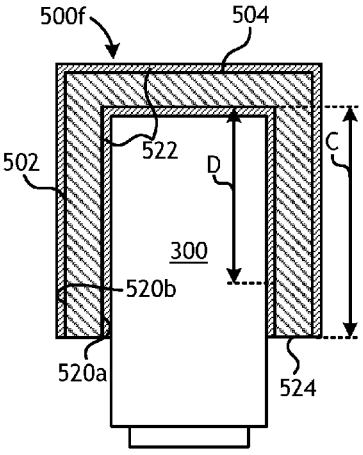

With continued reference to FIG. 5F, this may alternatively be accomplished by having an undulating or variable bottom surface 524. More particularly, the bottom surface 524 may be designed such that it provides alternating hills and valleys (e.g., high points and low points, respectively) about the circumference of the mold assembly 300. More particularly, the sidewall 502 may have a first depth C at one angular location about the mold assembly 300, but may exhibit a second depth D at a second angular location about the mold assembly 300, where the second depth D is less than the first depth. As a result, the thermal material of the caps 500*a-f* is only able to extend to the second depth D at some locations about the mold assembly 300 while extending to the first greater depth C at other locations about the mold assembly 300.

Those skilled in the art will readily recognize the advantage that the undulating or variable bottom surface 524 of the caps 500*a-f* may provide. For instance, the undulating bottom surface 524 may provide an operator with the ability to angularly align more or less insulative thermal material with desired locations about the circumference of the mold assembly 300 to align with certain portions of the infiltrated downhole tool. In some embodiments, for example, it may be desired to include increased amounts of insulative thermal material radially adjacent portions of the infiltrated downhole tool that exhibit higher thermal mass, such as the locations of the cutter blades 102 of the drill bit 100 (FIGS. 1 and 2). On the other hand, it may alternatively be desired to have decreased amounts of insulative thermal material radially adjacent portions of the infiltrated downhole tool that have less thermal mass, such as the locations of the junk slots 124 the drill bit 100. As will be appreciated, such embodiments may allow an operator to focus the thermal property advantages provided by the caps 500*a-f* in areas that are more susceptible to defects.

In any of the embodiments described herein, the cap 500*a-f* may be composed of multiple thin-walled nested cap members, similar to stacking cups or blocks. In such embodiments, the thickness of the resulting cap 500*a-f* may be customized and configured for various sizes and shapes of the mold assembly 300. As an example, the inner nested cap member may be similar to the first cap 500*a*, directly contacting the mold assembly 300, with at least one additional nested cap member disposed about the outer surface of the first cap 500*a*, such as the cap 500*b*. As will be appreciated, such an arrangement may produce a radiant barrier within the macroscopic cap. It will be appreciated that any of the presently disclosed embodiments of any of the mold assembly caps may be combined in a nested relationship, without departing from the scope of the disclosure.

Referring now to FIGS. 6A-6E, illustrated are partial cross-sectional side views of the mold assembly 300 incorporating various designs and/or configurations of an additional exemplary mold assembly cap 600, according to one or more embodiments. The various embodiments of the mold assembly cap 600 are depicted in FIGS. 6A-6E as mold assembly caps 600*a-e*, respectively. The mold assembly caps 600*a-e* (hereafter "caps 600*a-e*") may be similar in some respects to the caps 500*a-f* of FIGS. 5A-5F and therefore may be best understood with reference thereto, where like numerals represent like elements not described again in detail. For instance, similar to the caps 500*a-f*, each cap 600*a-e* may include the sidewall 502 and, in some embodiments, may further include the top member 504. Unlike the caps 500*a-f*, however, the caps 600*a-e* may include and otherwise incorporate a support structure 602 configured to support or otherwise house the thermal materials of the caps 600*a-e*.

Figure 6A:
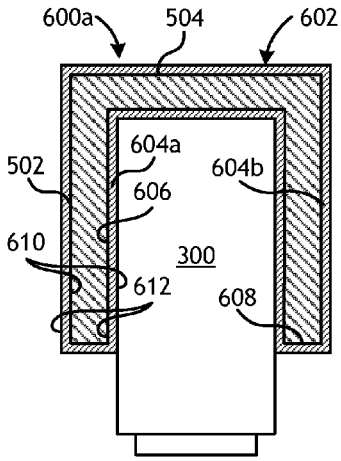
FIGS. 6A-6E are partial cross-sectional side views of the mold assembly of FIG. 3 incorporating various designs and/or configurations of another exemplary mold assembly cap.

In FIG. 6A, for example, the support structure 602 of the cap 600*a* may include an inner frame 604*a* and an outer frame 604*b* and the thermal material of the cap 600*a* may be supported and otherwise encapsulated within the support structure 602 between the inner and outer frames 604*a,b*. The inner and outer frames 604*a,b* may cooperatively define a cavity 606 configured to receive and otherwise house the thermal material of the cap 600*a* therein. In some embodiments, as illustrated, the support structure 602 may further include a footing 608 at the bottom end of the support structure 602 that extends at least partially between the inner and outer frames 604*a,b*. The footing 608 may serve as a support for the thermal material of the cap 600*a*, and may prove especially useful when the thermal material of the cap 600*a* includes stackable and/or individual component thermal materials that may be stacked atop one another within the cavity 606.

The support structure 602, including one or both of the inner and outer frames 604*a,b*, may be made of any rigid material including, but not limited to, metals (e.g., a sheet metal, an expanded metal or mesh, a slotted metal, machined, cast, forged, etc.), ceramics (e.g., a molded ceramic substrate), graphite, alumina, composite materials, combinations thereof, and the like. The support structure 602 may exhibit any suitable horizontal cross-sectional shape that will accommodate the general shape of the mold assembly 300 including, but not limited to, circular, ovular, polygonal, polygonal with rounded corners, or any hybrid thereof. In some embodiments, the support structure 602 may exhibit different horizontal cross-sectional shapes and/or sizes at different vertical or longitudinal locations.

In some embodiments, a reflective coating 610 or material may be positioned on an inner surface of the support structure 602. The reflective coating 610 may be the same as or similar to the reflective coating 522 described above with reference to FIG. 5F, and therefore will not be described again in detail. The reflective coating 610 may be adhered to and/or sprayed onto the inner surface of at least one of the inner and outer frames 604*a,b* to reflect thermal energy emitted from the mold assembly 300 back toward the mold assembly 300. In some embodiments, the reflective coating 610 may be the support structure 602. In some embodiments, a thermal barrier 612 may be applied to an outer surface of at least one of the inner and outer frames 604*a,b* to provide a thermal barrier between adjacent materials. The thermal barrier 612 may also be the same as or similar to the thermal barrier coating 522 described above with reference to FIG. 5F, and therefore will not be described again in detail. In yet other embodiments, or in addition thereto, the inner surface of at least one of the inner and outer frames 604*a,b* may be polished to increase its emissivity.

Figure 6B:
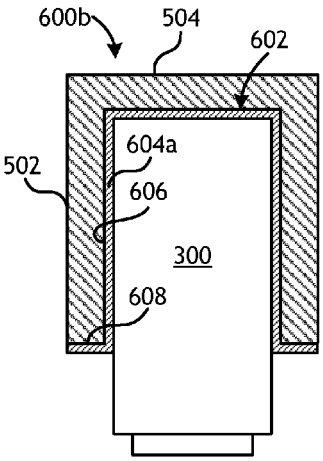

In FIG. 6B, the outer frame 604*b* of the support structure 602 of the cap 600*b* may be omitted and the thermal material of the cap 600*b* may alternatively be supported solely by the inner frame 604*a* and/or the footing 608. In some embodiments, the thermal material of the cap 600*b* may be coupled or otherwise fastened to the inner frame 604*a* using one or more mechanical fasteners (not shown), such as bolts, screws, pins, etc. In other embodiments, the inner frame 604*a* may alternatively be omitted from the support structure 602 and the thermal material of the cap 600*a* may instead be supported by the outer frame 604*a* and/or the footing 608.

Figure 6C:
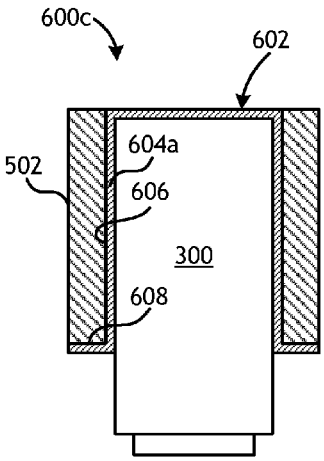

In FIG. 6C, the top member 504 is omitted from the cap 600*c*, which may include only the sidewall 502 as supported by the support structure 602. More particularly, the support structure 602 for the cap 600*c* may be similar to the support structure 602 for the cap 600*b* of FIG. 6*b*, where the outer frame 604*b* is omitted and the thermal material of the cap 600*c* may alternatively be supported solely by the inner frame 604*a* and/or the footing 608. In at least one embodiment, the thermal material of the cap 600*b* may encompass a monolithic cylindrical block of thermal material, such as a ceramic or graphite. In other embodiments, the thermal material of the cap 600*c* along the sidewall 502 may be supported on the support structure 602 by other methods or means including, but not limited to wires, cables, interference fits, an angled interface, a threaded interface, one or more key slots, or any combination thereof.

Figure 6D:
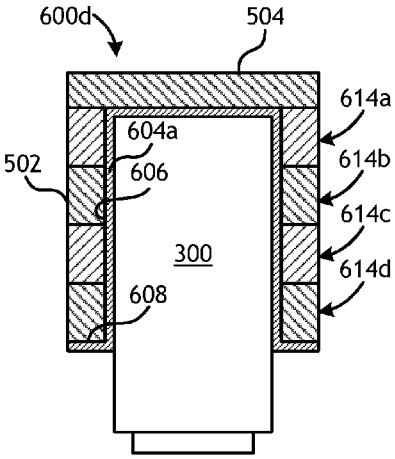

In FIG. 6D, the support structure 602 for the cap 600*d* may be similar to the support structure 602 for the caps 600*b* and 600*c* of FIGS. 6B and 6C, respectively. Unlike the caps 600*b,c*, however, the thermal material of the cap 600*d* along the sidewall 502 may be made of a plurality of vertically-stackable rings 614 (shown as rings 614*a*, 614*b*, 614*c*, and 614*d*). Each ring 614*a-d* may be made of the same or different materials, such as any of the thermal materials mentioned above. Using different materials for one or more of the rings 614*a-d* may prove advantageous in being able to control heat loss along the height of the mold assembly 300.

In some embodiments, each ring 614*a-d* may form or provide a monolithic annular structure that extends about the entire circumference of the inner frame 604*a* within the cavity 606. For example, the fourth ring 614*d* may be first placed within the cavity 606 and rested on the footing 608, the third ring 614*c* may be positioned atop the fourth ring 614*d*, the second ring 614*b* may be positioned atop the third ring 614*c*, and the first ring 614*a* may be positioned atop the second ring 614*b*. In other embodiments, however, each ring 614*a-d* may comprise a plurality of individual bricks or blocks of the thermal material of the cap 600*d* arranged end-to-end (i.e., side by side) around the inner frame 604*a* within the cavity 606. In such embodiments, the individual bricks or blocks of the rings 614*a-d* may each cooperatively form respective rings that may be sequentially positioned and stacked atop one another within the cavity 606, as described above.

While a vertical stack of four rings 614*a-d* are depicted in FIG. 6D, those skilled in the art will readily appreciate that fewer or greater than four rings 614*a-d* may be employed in the cap 600*d*, without departing from the scope of the disclosure. In at least one embodiment, for instance, the four rings 614*a-d* may be substituted with a single, continuous, monolithic, cylindrical sidewall ring that extends along the entire circumference of the insulation enclosure 300 within the cavity 606 and also extends between the top and bottom ends of the support structure 602.

The top member 504 of the cap 600*d* positioned across the top end of the support structure 602 may be composed of or otherwise include a plurality of individual insulation bricks or blocks (not shown) that are supported by the top wall of the support structure 602. In other embodiments, as illustrated, the top member 504 may be a monolithic disc supported by (e.g., positioned atop) the support structure 602.

Figure 6E:
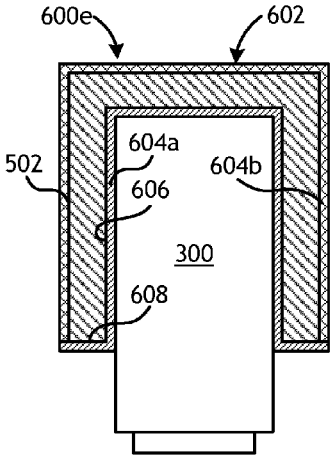

In FIG. 6E, the support structure 602 for the cap 600*e* includes both the inner and outer frames 604*a,b* and the footing 608. The inner and outer frames 604*a,b* of the support structure 602 of FIG. 6E, however, may be made of different materials or of a different structural configuration. For instance, in some embodiments, the inner frame 604*a* may be made of expanded metal while the outer frame 604*b* may be made of polished sheet metal, slotted metal, or a thermal barrier coating, similar to the thermal barrier 612 of FIG. 6A.

Figure 7A:
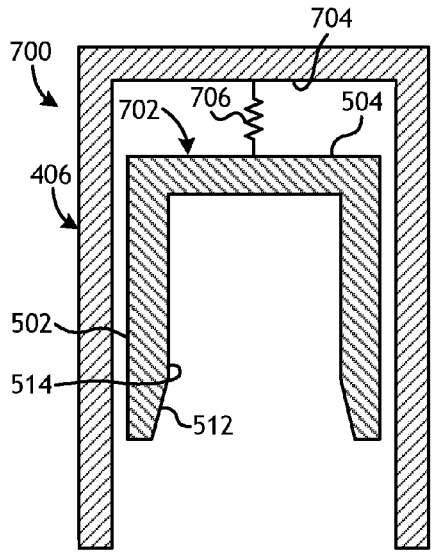
FIGS. 7A and 7B are partial cross-sectional views of a mold assembly system used to insulate the mold assembly of FIG. 3.
Figure 7B:
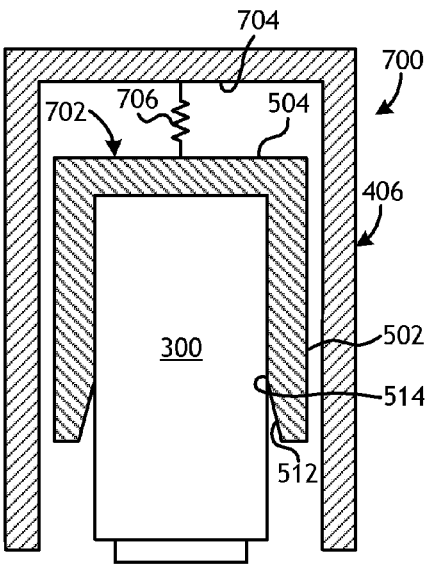

Referring now to FIGS. 7A and 7B, illustrated are partial cross-sectional views of a mold assembly system 700 used to insulate the mold assembly 300, according to one or more embodiments. As illustrated, the mold assembly system 700 may include the insulation enclosure 406 of FIGS. 4A and 4B, and a mold assembly cap 702 suspended within the insulation enclosure 406. The mold assembly cap 702 (hereafter "the cap 702") may be the same as or similar to any of the mold assembly caps described herein. In at least one embodiment, however, the cap 702 may be similar to the cap 500*c* of FIG. 5C. Accordingly, the cap 702 may include the sidewall 502, the top member 504, and the tapered surface 512 defined on the inner wall 514 of the sidewall 502.

The cap 702 may be suspended and otherwise movably coupled to a top inner surface 704 of the insulation enclosure 406 with one or more compliant devices 706 (one shown). The compliant device 706 may be configured to hang the cap 702 within the insulation enclosure 406 and bias or otherwise urge the cap 702 into position on the mold assembly 300. It should be noted that while only one compliant device 706 is depicted in FIGS. 7A and 7B, it will be appreciated that more than one compliant device 706 may be employed, without departing from the scope of the disclosure. In some embodiments, for instance, two or more compliant devices 706 may be strategically positioned to control or affect the range of movement of the cap 702. In the illustrated embodiment, the compliant device 706 is depicted as a spring, such as a coil spring or a compression spring. It will be appreciated that the compliant device 706 may be any type of compliant member, device, or mechanism capable of biasing or otherwise positioning the cap 702 on the mold assembly 300, as discussed below.

In FIG. 7A, the cap 702 is depicted as being suspended within the insulation enclosure 406 with the compliant device 706. In FIG. 7B, the mold assembly 300 is introduced into the mold assembly system 700 and the cap 702 is positioned on the mold assembly 300. As will be appreciated, the tapered surface 512 of the cap 702 may prove advantageous in allowing the cap 702 to more easily locate and be positioned on the mold assembly 300. In some embodiments, the compliant device 706 may be a compression spring and positioning the cap 702 on the mold assembly 300 may compress the compliant device 706 such that built-up spring forces urge the cap 702 into continuous contact with the outer surfaces of the mold assembly 300.

Figure 8A:
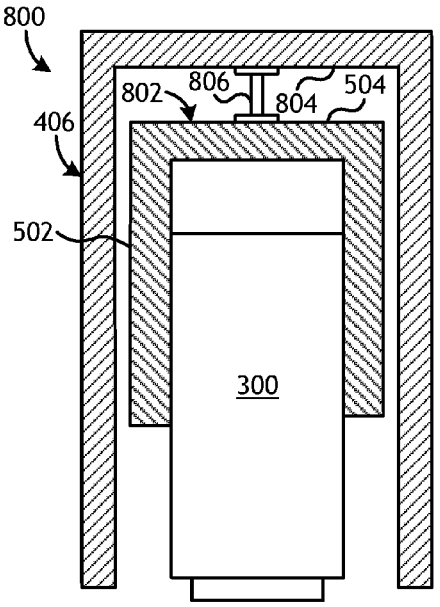
FIGS. 8A and 8B are partial cross-sectional views of another mold assembly system used to insulate the mold assembly of FIG. 3.
Figure 8B:
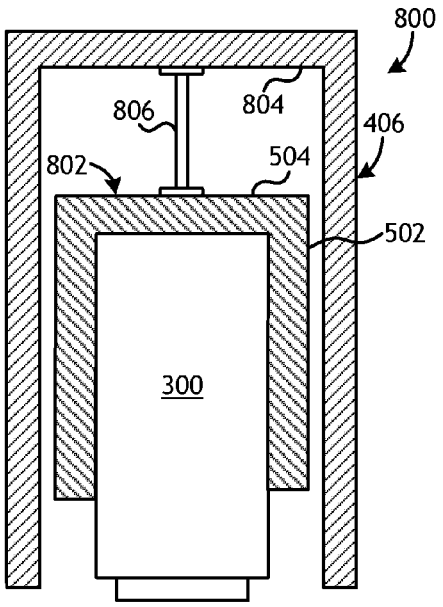

Referring now to FIGS. 8A and 8B, illustrated are partial cross-sectional views of another mold assembly system 800 used to insulate the mold assembly 300, according to one or more embodiments. Similar to the mold assembly system 700 of FIGS. 7A-7B, the mold assembly system 800 may include the insulation enclosure 406 of FIGS. 4A and 4B, and a mold assembly cap 802 suspended at least temporarily within the insulation enclosure 406 from a top inner surface 804 with one or more compliant devices 806 (one shown). The mold assembly cap 802 (hereafter "the cap 802") may be the same as or similar to any of the mold assembly caps described herein. In at least one embodiment, however, the cap 802 may be similar to the cap 500*a* of FIG. 5A. Accordingly, the cap 802 may include the sidewall 502 and the top member 504.

Unlike the compliant device 706 of FIGS. 7A-7B, however, the compliant device 806 in FIGS. 8A-8B, may be a mechanical actuation device that, when triggered or activated, allows the cap 802 to move into position on the mold assembly 300. In some embodiments, the compliant device 806 may be actuated by an operator as desired. In other embodiments, an automated control system (not shown) may be used to actuate the compliant device 806 at a predetermined time or following a predetermined methodology. The mechanical actuation device may comprise a variety of types of actuation devices including, but not limited to, an air cylinder, a piston solenoid assembly, a fusible link, an exploding bolt, or any other type of actuation devices (i.e., mechanical, electromechanical, electrical, hydraulic, pneumatic, etc.) known to those skilled in the art.

In embodiments where the compliant device 806 is an air cylinder or a piston solenoid assembly, the compliant device 806 may be actuated or otherwise activated to move the cap 802 with respect to the mold assembly 300. In such embodiments, the compliant device 806 may be actuated to move the cap 802 into position about the mold assembly 300, and also retract or otherwise remove the cap 802 from contact with the mold assembly 300. As will be appreciated, raising the cap 802 at a predetermined rate during cooling of the infiltrated downhole tool may prove advantageous in developing a variable thermal gradient that may help facilitate directional solidification of the infiltrated downhole tool.

In embodiments where the compliant device 806 is a fusible link, the fusible link may be designed and otherwise configured to hold the cap 802 stationary within the insulation enclosure 406 while in one phase, and move the cap 802 into position on the mold assembly 300 when the material changes to a second phase. Such movement could be caused by, but not limited to, energy stored in the system, potential energy derived from gravity, springs, gas cylinders, chemical energy (both internal and external to the immediate system), electrical energy triggered by the fusible link, and any combination thereof. In some embodiments, the fusible link may be tailored to sever and drop the cap 802 into position on the mold assembly 300 when the temperature within the insulation enclosure 406 reaches a predetermined temperature or after a predetermined period of time.

In embodiments where the compliant device 806 is an exploding bolt or the like, the compliant device 806 may be severed and drop the cap 802 into position on the mold assembly 300 upon command provided by an operator or after a predetermined period of time.

Referring jointly to FIGS. 7A-7B and 8A-8B, in some embodiments, two or more compliant devices 706, 806 may be used to suspend a given mold assembly cap within the insulation enclosure 406 and may include differing types of compliant devices 706, 806. For example, one compliant device 806 may be an actuated piston, and a second compliant device 706 may be a spring. In such an embodiment, the two compliant devices 706, 806 may cooperatively prove advantageous in manipulating the position of the given mold assembly cap to a preferred or predetermined configuration to receive the mold assembly 300. Such hybrid compliant/actuation designs could produce certain advantages, such as lower-cost designs, reduced controlling requirements, and assistance in ensuring proper alignment of the given mold assembly cap as it is lowered onto the mold assembly 300.

Figure 9A:
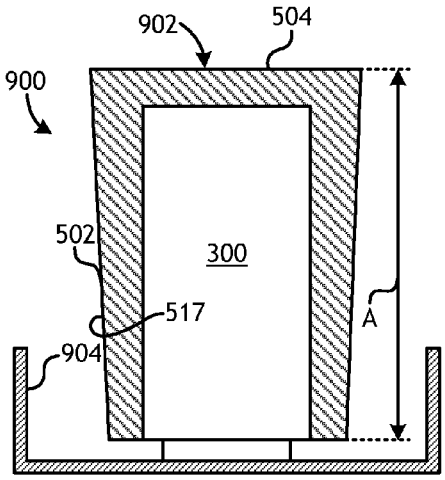
FIGS. 9A and 9B are partial cross-sectional views of another mold assembly system used to insulate the mold assembly of FIG. 3.
Figure 9B:
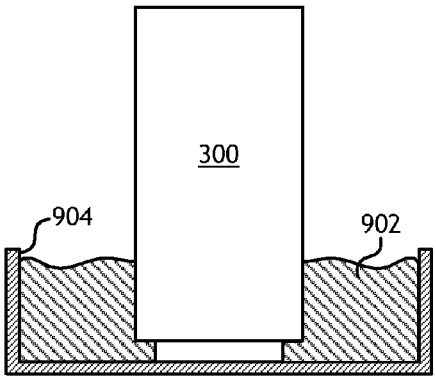

Referring now to FIGS. 9A and 9B, illustrated are partial cross-sectional views of another mold assembly system 900 used to insulate the mold assembly 300, according to one or more embodiments. As illustrated, the mold assembly system 900 may include a mold assembly cap 902 (hereafter "the cap 902") that may be the same as or similar to any of the mold assembly caps described herein. In at least one embodiment, the cap 902 may be similar to the cap 500*d* of FIG. 5D. Accordingly, the cap 902 may include the sidewall 502, the top member 504, and an outer wall 517 of the sidewall 502 that tapers outward from the bottom to the top along the height A.

The thermal material of the cap 902 may be capable of passing through a phase change, such as from a solid state to a liquid or molten state. The phase change thermal material may be configured to pass through solid/liquid phases at a specific temperature or at a predetermined time. Suitable phase change thermal materials for the cap 902 include, but are not limited to, metals, salts, exothermic powders, or any material that changes phase below about 2,500° F. Suitable metals for the phase change thermal material may include a metal similar to the binder material 324 of FIG. 3 such as, but not limited to, copper, nickel, manganese, lead, tin, cobalt, silver, phosphorous, zinc, any alloys thereof, and any mixtures of the metallic alloys. Using a phase change thermal material that is similar to the binder material 324 may prove advantageous since they will each have the same solidus and liquidus temperatures. As a result, the phase change thermal material may be able to provide latent heat to the molten contents of the mold assembly 300 at essentially the same thermal points. Suitable exothermic powders for the phase change thermal material may include a hot topping compound, such as FEEDOL®, which is commonly used in foundries.

The mold assembly system 900 may further include a catch pan or reservoir 904 to catch and contain the phase change thermal material of the cap 902 as it liquefies. In operation, the cap 902 may be configured to change shape and/or position relative to the mold assembly 300 while cooling the contents therein. In some embodiments, the phase change thermal material of the cap 902 liquefies and descends into the reservoir 904. This phase change and the corresponding change in thermal characteristics of the phase change thermal material may be time and/or temperature based, depending on the energy transferred into the phase change thermal material. As will be appreciated, the liquefied phase change thermal material may be able to draw thermal energy out of the mold assembly 300 at a higher rate.

Figure 10A:
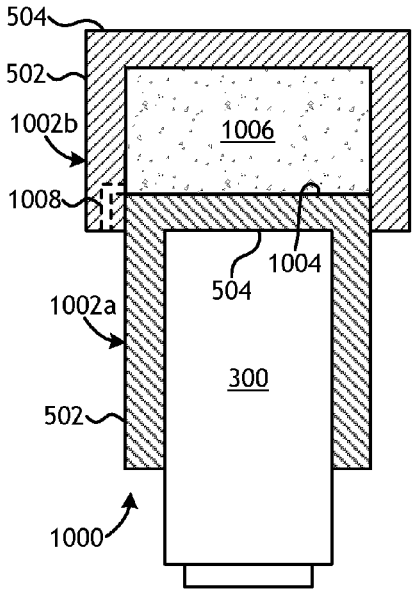
FIGS. 10A and 10B are partial cross-sectional views of another mold assembly system used to insulate the mold assembly of FIG. 3.
Figure 10B:
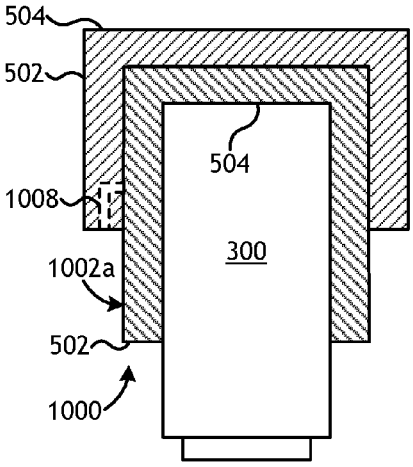

Referring now to FIGS. 10A and 10B, illustrated are partial cross-sectional views of another mold assembly system 1000 used to insulate the mold assembly 300, according to one or more embodiments. As illustrated, the mold assembly system 1000 may include a first mold assembly cap 1002*a* (hereafter "the first cap 1002*a*") and a second mold assembly cap 1002*b* (hereafter "the second cap 1002*b*"). The first cap 1002*a* may be the same as or similar to any of the mold assembly caps described herein. In at least one embodiment, the first cap 1002*a* may be similar to the cap 500*a* of FIG. 5A. Accordingly, the first cap 1002*a* may include the sidewall 502 and the top member 504.

The second cap 1002*b* may also be the same as or similar to any of the mold assembly caps described herein, but may be configured to be positioned about and otherwise on top of the first cap 1002*a*. In the illustrated embodiment, the second cap 1002*b* also includes the sidewall 502 and the top member 504, but may further provide and otherwise define a cavity 1004 configured to contain a phase change thermal material 1006. Similar to the thermal material of the cap 902 of FIGS. 9A and 9B, the phase change thermal material 1006 may be capable of passing through a phase change, such as from a solid state to a liquid or molten state. Suitable materials for the phase change thermal material 1006 include, but are not limited to, metals, salts, and exothermic powders. Suitable metals for the phase change thermal material 1006 may include copper, nickel, manganese, lead, tin, cobalt, silver, phosphorous, zinc, any alloys thereof, and any mixtures of the metallic alloys. Suitable exothermic powders for the phase change thermal material 1006 may include a hot topping compound (e.g., FEEDOL®).

As it changes phase and liquefies or gasifies, the phase change thermal material 1006 may be able to escape the cavity 1004 via a flow port 1008 defined through the second cap 1002*b*, or any other location that allows the material to leave the cavity 1004. Allowing the liquefied phase change thermal material 1006 to escape the cavity 1004 may allow the second cap 1002*b* to descend onto the first cap 1002*a* and thereby change the thermal characteristics of the mold assembly system 1000. As will be appreciated, this phase change and the corresponding change in thermal characteristics can be time and/or temperature based depending on the energy transferred into the phase change thermal material 1006.

It will be appreciated that the various embodiments described and illustrated herein may be combined in any combination, in keeping within the scope of this disclosure. Indeed, variations in the size and configuration of any of the mold assembly caps described herein may be implemented in any of the embodiments, as generally described herein. Likewise, variations in the size and configuration of any of the assemblies that incorporate the presently described mold assembly caps may be implemented according to any of the presently described embodiments. Moreover, the different types of thermal material described and listed herein may be used in any of the mold assembly caps described herein, or in any combination, without departing from the scope of the disclosure.

Embodiments disclosed herein include:

A. A mold assembly system that includes a mold assembly that defines an infiltration chamber used for forming an infiltrated downhole tool, and a mold assembly cap positionable on the mold assembly and including a sidewall extendable about an outer periphery of the mold assembly at least partially along a height of the mold assembly, the sidewall exhibiting a horizontal cross-sectional shape that accommodates a shape of the mold assembly and the sidewall being made of a thermal material.

B. A method that includes providing a mold assembly that defines an infiltration chamber used for forming an infiltrated downhole tool, positioning a mold assembly cap on the mold assembly, the mold assembly cap including a sidewall extendable about an outer periphery of the mold assembly at least partially along a height of the mold assembly, and the sidewall exhibiting a horizontal cross-sectional shape that accommodates a shape of the mold assembly, wherein the sidewall is made of a thermal material, and promoting directional solidification of the infiltrated downhole tool with the mold assembly cap.

Each of embodiments A and B may have one or more of the following additional elements in any combination: Element 1: wherein the mold assembly cap further includes a top member extendable across a top of the mold assembly, the top member being made of the thermal material. Element 2: wherein the thermal material comprises a material selected from the group consisting of alumina, a ceramic, ceramic fibers, a ceramic fabric, a ceramic wool, ceramic beads, a ceramic, a moldable ceramic, a woven ceramic, a cast ceramic, a fire brick, carbon fibers, a graphite block, a shaped graphite block, polymer beads, a polymer fiber, a polymer fabric, a nanocomposite, a fluid in a jacket, steel, a metal fabric, a metal foam, a metal wool, a metal casting, stone, graphite, a phase change material, any composite thereof, and any combination thereof. Element 3: further comprising one or more longitudinal protrusions defined on an inner surface of the sidewall and interposing the sidewall and adjacent outer surfaces of the mold assembly to thereby define a gap between the sidewall and the outer periphery of the mold assembly. Element 4: further comprising one or more top protrusions defined on an inner surface of the top member, the one or more top protrusions interposing the top member and adjacent outer surfaces of the mold assembly. Element 5: wherein the sidewall defines an inner tapered surface. Element 6: wherein a thickness of the sidewall varies along an axial height of the mold assembly cap. Element 7: wherein a type of the thermal material varies along a height of the mold assembly cap. Element 8: further comprising one or more thermal elements positioned within one or both of the sidewall and the top member. Element 9: further comprising a coating applied to one or both of an inner surface and an outer surface of the mold assembly cap, the coating including at least one of a reflective coating and a thermal barrier coating. Element 10: further comprising a support structure that supports the thermal material. Element 11: wherein at least one of a reflective coating and a thermal barrier is applied to a surface of the support structure. Element 12: wherein the thermal material comprises one or more vertically-stackable rings. Element 13: further comprising an insulation enclosure, and one or more compliant devices coupled to a top inner surface of the insulation enclosure to suspend the mold assembly cap within the insulation enclosure. Element 14: wherein the one or more compliant devices is selected from the group consisting of a spring, a mechanical actuation device, an air cylinder, a piston solenoid assembly, a fusible link, an exploding bolt, and any combination thereof. Element 15: wherein the mold assembly cap is a first mold assembly cap and the mold assembly system further comprises a second mold assembly cap including a second sidewall and a second top member, the second sidewall being extendable about the sidewall of the first mold assembly, a phase change thermal material contained within a cavity defined at least partially between the second sidewall and the second top member, and a flow port defined in the second mold assembly cap to allow the phase change thermal material to escape the cavity upon being liquefied, wherein allowing the phase change thermal material to escape the cavity allows the second mold assembly cap to descend onto the first mold assembly cap.

Element 16: wherein the mold assembly cap further includes a top member made of the thermal material and extendable across a top of the mold assembly, and wherein promoting directional solidification of the infiltrated downhole tool with the mold assembly cap comprises promoting directional solidification of the infiltrated downhole tool with the sidewall and the top member. Element 17: further comprising forming a radiant barrier between the sidewall and the mold assembly with one or more longitudinal protrusions defined on an inner surface of the sidewall and interposing the sidewall and adjacent the outer periphery of the mold assembly. Element 18: further comprising forming a radiant barrier between the mold assembly cap and the mold assembly with at least one of longitudinal protrusions defined on an inner surface of the sidewall and one or more top protrusions defined on an inner surface of the top member. Element 19: further comprising selectively heating the mold assembly with one or more thermal elements positioned within one or both of the sidewall and the top member. Element 20: further comprising altering a thermal property of the mold assembly cap by applying a coating to one or both of an inner surface and an outer surface of the mold assembly cap, the coating including at least one of a reflective coating and a thermal barrier coating. Element 21: further comprising suspending the mold assembly cap within an insulation enclosure using one or more compliant devices coupled to a top inner surface of the insulation enclosure, and lowering the insulation cap over the mold assembly, and thereby positioning the mold assembly cap on the mold assembly. Element 22: wherein the one or more compliant devices is a compression spring and wherein lowering the insulation cap over the mold assembly comprises locating the mold assembly with the mold assembly cap, lowering the mold assembly cap onto the mold assembly as the insulation cap is lowered, compressing the compression spring as the mold assembly cap is lowered onto the mold assembly, and urging the mold assembly into contact with the mold assembly with spring forces built up in the compression spring. Element 23: wherein the one or more compliant devices is a mechanical actuation device and wherein lowering the insulation cap over the mold assembly comprises locating the mold assembly with the mold assembly cap, and actuating the mechanical actuation device to lower the mold assembly cap onto the mold assembly. Element 24: further comprising actuating the mechanical actuation device to raise the mold assembly cap with respect to the mold assembly, and generating a variable thermal gradient in the mold assembly as the mold assembly cap is raised by the mechanical actuation device. Element 26: wherein the thermal material comprises a phase change material, and wherein promoting directional solidification of the infiltrated downhole tool with the mold assembly cap further comprises liquefying the phase change material, and containing the liquefied phase change material in a reservoir. Element 26: wherein the mold assembly cap is a first mold assembly cap, the method further comprising positioning a second mold assembly cap on the first mold assembly cap, the first mold assembly cap including a second sidewall and a second top member, and the second sidewall being extendable about the sidewall of the first mold assembly, liquefying a phase change thermal material contained within a cavity defined at least partially between the second sidewall and the second top member, flowing the liquefied phase change thermal material out of the cavity via a flow port defined in the second mold assembly cap, and lowering the second mold assembly cap with respect to the first mold assembly cap as the liquefied phase change thermal material flows out of the cavity.

By way of non-limiting example, exemplary combinations applicable to A, B, and C include: Element 1 with Element 2; Element 1 with Element 4; Element 1 with Element 8; Element 10 with Element 11; Element 10 with Element 12; Element 13 with Element 14; Element 1 with Element 15; Element 17 with Element 18; Element 21 with Element 22; Element 21 with Element 23; and Element 24 with Element 25.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A mold assembly system, comprising:

a mold assembly that defines an infiltration chamber used for forming an infiltrated downhole tool; and a mold assembly cap positionable on the mold assembly and including a sidewall extendable about an outer periphery of the mold assembly at least partially along a height of the mold assembly, the sidewall comprising a thermal material and exhibiting a horizontal cross-sectional shape that accommodates a shape of the mold assembly, wherein the mold assembly cap further includes a top member extendable across a top of the mold assembly, the top member being made of the thermal material, wherein the thermal material comprises a material selected from the group consisting of carbon fibers, a nanocomposite, a fluid in a jacket, stone, any composite thereof, and any combination thereof.

2. The mold assembly system of claim 1, further comprising one or more longitudinal protrusions defined on an inner surface of the sidewall and interposing the sidewall and adjacent outer surfaces of the mold assembly to thereby define a gap between the sidewall and the outer periphery of the mold assembly.

3. The mold assembly system of claim 1, further comprising one or more top protrusions defined on an inner surface of the top member, the one or more top protrusions interposing the top member and adjacent outer surfaces of the mold assembly.

4. The mold assembly system of claim 1, wherein the sidewall defines an inner tapered surface.

5. The mold assembly system of claim 1, wherein a thickness of the sidewall varies along an axial height of the mold assembly cap.

6. The mold assembly system of claim 1, wherein a type of the thermal material varies along a height of the mold assembly cap.

7. The mold assembly system of claim 1, further comprising one or more thermal elements positioned within one or both of the sidewall and the top member.

8. The mold assembly system of claim 1, further comprising a coating applied to one or both of an inner surface and an outer surface of the mold assembly cap, the coating including at least one of a reflective coating and a thermal barrier coating.

9. The mold assembly system of claim 1, further comprising a support structure that supports the thermal material.

10. The mold assembly system of claim 9, wherein at least one of a reflective coating and a thermal barrier is applied to a surface of the support structure.

11. The mold assembly system of claim 9, wherein the thermal material comprises one or more vertically-stackable rings.

12. The mold assembly system of claim 1, further comprising:

an insulation enclosure; and one or more compliant devices coupled to a top inner surface of the insulation enclosure to suspend the mold assembly cap within the insulation enclosure.

13. The mold assembly system of claim 12, wherein the one or more compliant devices is selected from the group consisting of a spring, a mechanical actuation device, an air cylinder, a piston solenoid assembly, a fusible link, an exploding bolt, and any combination thereof.

14. The mold assembly system of claim 1, wherein the mold assembly cap is a first mold assembly cap and the mold assembly system further comprises:

a second mold assembly cap including a second sidewall and a second top member, the second sidewall being extendable about the sidewall of the first mold assembly;

a phase change thermal material contained within a cavity defined at least partially between the second sidewall and the second top member; and a flow port defined in the second mold assembly cap to allow the phase change thermal material to escape the cavity upon being liquefied, wherein allowing the phase change thermal material to escape the cavity allows the second mold assembly cap to descend onto the first mold assembly cap.

15. A mold assembly system, comprising:

a mold assembly that defines an infiltration chamber used for forming an infiltrated downhole tool;

a mold assembly cap positionable on the mold assembly and including a sidewall extendable about an outer periphery of the mold assembly at least partially along a height of the mold assembly, the sidewall comprising a thermal material and exhibiting a horizontal cross-sectional shape that accommodates a shape of the mold assembly; and at least one of:

one or more longitudinal protrusions defined on an inner surface of the sidewall and interposing the sidewall and adjacent outer surfaces of the mold assembly to thereby define a gap between the sidewall and the outer periphery of the mold assembly;

a coating applied to one or both of an inner surface and an outer surface of the mold assembly cap, the coating including at least one of a reflective coating and a thermal barrier coating;

an insulation enclosure and one or more compliant devices coupled to a top inner surface of the insulation enclosure to suspend the mold assembly cap within the insulation enclosure;

an inner tapered surface defined by the sidewall; or a support structure that supports the thermal material.

16. The mold assembly system of claim 15, wherein the mold assembly system comprises the one or more longitudinal protrusions.

17. The mold assembly system of claim 15, wherein the mold assembly system comprises the coating.

18. The mold assembly system of claim 15, wherein the mold assembly system comprises the insulation enclosure and one or more compliant devices.

19. The mold assembly system of claim 18, wherein the one or more compliant devices is selected from the group consisting of a spring, a mechanical actuation device, an air cylinder, a piston solenoid assembly, a fusible link, an exploding bolt, and any combination thereof.

20. The mold assembly system of claim 15, wherein the mold assembly system comprises the inner tapered surface.

21. The mold assembly system of claim 15, wherein the mold assembly system comprises the support structure.

22. The mold assembly system of claim 21, wherein at least one of a reflective coating and a thermal barrier is applied to a surface of the support structure.

23. The mold assembly system of claim 21, wherein the thermal material comprises one or more vertically-stackable rings.

24. A mold assembly system, comprising:

a mold assembly that defines an infiltration chamber used for forming an infiltrated downhole tool; and a mold assembly cap positionable on the mold assembly and including a sidewall extendable about an outer periphery of the mold assembly at least partially along a height of the mold assembly, the sidewall comprising a thermal material and exhibiting a horizontal cross-sectional shape that accommodates a shape of the mold assembly, wherein the mold assembly cap further includes a top member extendable across a top of the mold assembly, the top member being made of the thermal material; and at least one of:

one or more top protrusions defined on an inner surface of the top member, the one or more top protrusions interposing the top member and adjacent outer surfaces of the mold assembly; or one or more thermal elements positioned within one or both of the sidewall and the top member.

25. The mold assembly system of claim 24, wherein the mold assembly system comprises the one or more top protrusions.

26. The mold assembly system of claim 24, wherein the mold assembly system comprises the one or more thermal elements.

27. The mold assembly system of claim 24, wherein the mold assembly cap is a first mold assembly cap and the mold assembly system further comprises:

a second mold assembly cap including a second sidewall and a second top member, the second sidewall being extendable about the sidewall of the first mold assembly;

a phase change thermal material contained within a cavity defined at least partially between the second sidewall and the second top member; and a flow port defined in the second mold assembly cap to allow the phase change thermal material to escape the cavity upon being liquefied, wherein allowing the phase change thermal material to escape the cavity allows the second mold assembly cap to descend onto the first mold assembly cap.

* * * * *